US008592342B2

(12) United States Patent
Millares Neyra et al.

(10) Patent No.: US 8,592,342 B2
(45) Date of Patent: Nov. 26, 2013

(54) DEVELOPMENT OF A THERMAL PAPER PRODUCED ON A VERY SMOOTH PAPER

(76) Inventors: Ricardo Millares Neyra, Delegacion Azcapotzalco (MX); Ricardo Millares Sotres, Delegacion Azcapotzalco (MX); Dalila Rivera Carmona, Delegacion Azcapotzalco (MX)

( * ) Notice: Subject to any disclaimer, the term of this patent is extended or adjusted under 35 U.S.C. 154(b) by 500 days.

(21) Appl. No.: 12/742,174

(22) PCT Filed: Nov. 11, 2008

(86) PCT No.: PCT/MX2008/000153

§ 371 (c)(1),
(2), (4) Date: Sep. 20, 2010

(87) PCT Pub. No.: WO2009/064153

PCT Pub. Date: May 22, 2009

(65) Prior Publication Data

US 2011/0003687 A1 Jan. 6, 2011

(30) Foreign Application Priority Data

Nov. 20, 2007 (MX) ..... MX/a/2007/014121

(51) Int. Cl.
*B41M 5/337* (2006.01)

(52) U.S. Cl.
USPC ..... 503/209; 427/150; 503/214

(58) Field of Classification Search
None
See application file for complete search history.

(56) References Cited

U.S. PATENT DOCUMENTS 6,165,937 A 12/2000 Puckett et al.
6,562,755 B1 5/2003 Halbrook, Jr. et al.

FOREIGN PATENT DOCUMENTS

JP 03-118185 * 5/1991
WO WO 2005/032838 A1 4/2005

* cited by examiner

*Primary Examiner* — Bruce H Hess
(74) *Attorney, Agent, or Firm* — Arnold & Porter LLP

(57) ABSTRACT

A thermal paper is described for the formation of images in thermal printing equipment and their manufacturing process, using high smoothness paper as a base or substrate. The thermal paper object of this invention is more economical and has a fully-acceptable performance. The high smoothness non-coated base paper has a greater high smoothness superficial finish than uncoated paper, and this development had not previously been used industrially for this purpose, since on trying to use the state of art of the process coupled with uncoated paper characteristics, the result was a low quality product. Hence, until now base papers had to be used with a previous coating the preparation of which increased production costs due to finished product characteristics, such as heavier weight (weight by square meter) and also a higher caliber.

9 Claims, No Drawings

DEVELOPMENT OF A THERMAL PAPER PRODUCED ON A VERY SMOOTH PAPER

1. SCOPE OF THE INVENTION

A method to obtain a paper with thermo sensitive surface characteristics for promoting the development of images in a wide range of thermal printers is described, comprising coating a sheet of uncoated paper having a high smoothness with a thermal material layer.

2. OBJECT OF THE INVENTION

The object of the present invention is to obtain a thermal paper with which clear and defined prints can be obtained from thermal printers, using uncoated papers with an initial high smoothness as a base. A lower production cost is obtained as the need for pre-coating the base paper is eliminated, and the thermal paper's performance requirements for today's high speed thermal printers for high definition images for various uses is met, as prints that include bar codes must be legible for optical readers.

Many techniques exist for applying the thermo sensitive layer to the base paper. One embodiment according to the present disclosure describes a composition and method of applying the thermo sensitive layer using the rod coating method. The rod coating method is more economical than many of the other methods used to apply a coating such as the thermo sensitive layer; however, traditional compositions of the thermo sensitive emulsion applied with the rod coating technique can be unsuitable for certain purposes due to the presence of grooves in the coating surface. The present invention allows for the use of the cost-effective rod coating method to apply the thermo sensitive layer on an uncoated base paper with a high smoothness, yielding a final uniform smooth surface that lacks the defects characteristic of other emulsions and methods of application. The invention described herein also permits the thermo sensitive layer to possess the adherence and stability characteristics required so as to not detach from the base paper during printing, writing, or handling of the print.

3. ANTECEDENTS

According to the state of the art, one type of material used in thermal printers is a base sheet of paper with a preliminary coating layer, which diminishes the roughness and increases the smoothness of the paper, and a second thermo sensitive layer, which is then applied to the preliminary coating layer. When heat is applied to the thermo sensitive layer, it generates a black or almost black color image.

In traditional thermal paper production, the base paper is often pre-coated with pigments and adhesives as a substrate that does not react with the thermo sensitive layer. Besides reducing the natural roughness of the paper, these pre-coating layers help to fix the thermo sensitive layer to the paper. This operation is mentioned in U.S. Pat. No. 6,165,937, issued Dec. 26, 2000; U.S. Pat. No. 6,613,716 issued Feb. 9, 2003; and international patent application publication no. WO 2005/084958, published Sep. 15, 2005. The use of pre-coated papers necessarily involves an additional step in the process and thus increases the cost of thermal paper production.

Alternatively, some materials used in thermal printers do not have a pre-coated base. If it is desired to utilize such a paper without a pre-coating base, a sufficiently thick thermo sensitive layer must be applied to the paper to compensate for its roughness. As a result, the product cost is considerably increased.

This type of product and component are described in U.S. Pat. No. 4,425,161, issued Jan. 10, 1984; U.S. Pat. No. 5,741,592, issued Apr. 21, 1998; U.S. Pat. No. 6,165,937, issued Dec. 26, 2000; U.S. Pat. No. 6,562,755, issued May 13, 2003; U.S. Pat. No. 6,613,716, issued Sep. 2, 2003; international patent application publication no. WO 2005/032838, published Apr. 14, 2005; and international patent application publication no. WO 2005/084958, published Sep. 15, 2005.

Traditionally, base papers with a high smoothness have not been used because, even though these possess the required surface smoothness uniformity, this same characteristic has hindered fixation of the thermo sensitive layer in the manufacturing process, as well as in its applications.

According to the current state of the art, the thermo sensitive layer is traditionally applied by aqueous dispersal effected mainly through "controlled grooving" by very precise systems, requiring expensive machinery and equipment.

As mentioned in previous paragraphs, the thermo sensitive layer typically consists of several components: color former, color developer, and sensitizer as described below:

Color formers usually comprise derivatives of compounds such as diamino fluoran, diarylmethane and azaphtalides. Among these color formers are some able to develop blue tones, such as the CVL (Caprolactam of Crystal Violet), reddish tones and black tones.

Color formers include among others: diarylmethanes such as 4,4-bis-(dimethylaminebenzhydroxylbenzyl)ether, N-halophenyl leuco auramine, N-2,4,5-trichlorophenyl leuco auramine; fluorans such as 2-dibenzilamine-6-diethylaminofluoran, 2-aniline-6-diethylaminofluoran, 3-methylaniline-6-diethylaminofluoran, 2-aniline-3-methyl-6-diethylaminofluorano, 2-aniline-3-methyl-6-(ethylisopentylamine) fluoran, 3,6-dimethoxyfluoran, 7,7'-bis-(3-diethylamino fluoran); spiro-pyrans such as 3-methyl-spiro-dinaphtopyran, 3-ethyl-spiro-dinaphtopyran, 3-benzyl-spiro-dinaphtopyran, 3,3'-diclhoro-spiro-dinaphtopyran, 3-methylnaphto-(3-methoxybenzoato)-spiro-pyran; azaphtalides such as 3-(2-ethoxy-4-diethyl-aminophenil)-3-(octyl-2-methylindole-3-1)-4-azaphtalide, 3-(2-ethoxy-4-diethylaminaphenil)-3-(1-ethyl-2-methylindole-3-1)-4-azaphtalide and indolphtalides such as 3-(p-dimethyl aminophenil)-3-(1,2-dimethylindol-3-1) phthalide, 3-(p-dimethylaminophenil)-3-(2-methylindole-3-1) phthalide.

Color developers include phenolic compounds such as: benzyl-4-hydroxybenzoate, bis-(3-allyl-4-hydroxyphenyl) sulfone, 2,4-dihydroxydiphenylsulfone, 4-hydroxyphenyl-4-isopropoxyphenylsulfone, p-hydroxybenzylphenol, 4,4-disulfonylphenol, 3-benzyl salicylic acid, 3-isopropyl salicylic acid, 4,4'-tiodiphenol phenol-formaldehyde resin novrolac, alphanaphtol, Bisphenol-A, bisphenol sulfone, 3,5-dimethyl-4-hydroxybenzoic acid, 4-4-4'-isopropyl diphenol and 3-3'-dimethyl-4-4'-tiodiphenol.

Sensitizers can be derivatives of fatty acids, such as acetamide or stearic acid amides. Alternatively, sensitizers can be derivatives of acidic compounds such as parahydroxy benzoic acid, dimethyl terephthalate, or dibenzyl terephthalate.

Another fundamental compound for the layer structure with good optical properties are the white pigments or loads such as, precipitated calcium carbonate, calcined kaolin, silica, calcined clay and/or plastic spheres.

DESCRIPTION OF THE INVENTION

One embodiment according to the present disclosure teaches the use of a base paper having a high degree of smoothness as substrate, which may be coated with a thermo sensitive layer formed by a fine aqueous dispersal (emulsion) of color formers, color developers and sensitizers that are initially white or colorless. When thermal energy is applied to the thermo sensitive layer, a chemical reaction generates desired images, mainly in black or blue. According to the present disclosure, the emulsion that serves as the thermo sensitive layer may include at least one color former component and at least one color developer. The emulsion may also include at least one defoamant, at least one surfactant, or a combination thereof. The emulsion may further include one or more pigments or white loads, one or more natural adhesives such as modified starches and/or synthetic as low viscosity partially hydrolyzed polyvinyl alcohol, and a binder such as a terpolymer which is an aqueous emulsion based on vinyl acetate, Veova™ (vinylester of versatic acid), and acryl ester.

By using an initial uncoated base paper with a high degree of smoothness, it is possible to eliminate the surface precoating, as the smoothness from the paper provides a suitable base over which the thermo sensitive layer can be applied.

One embodiment according to the present disclosure is directed towards the composition of a thermo sensitive layer and a method of applying the thermo-sensitive layer to a base paper with a high degree of smoothness. This process permits the coating and calibration of the thickness of the thermo sensitive layer when freshly applied through the coating rod process. The rheological and superficial tension characteristics of this formula have the effect of eliminating the characteristic surface defects normally present in other thermo sensitive papers known in the art. In this way, a thermo sensitive layer with a greater uniformity and smoothness is achieved than with traditional processes that use these types of rods for coating and calibrating the thickness of the fresh coating. This calibration process is more economical than alternative processes of coating such as the curtain or controlled, high-precision grooving process.

An additional characteristic of the present invention is that it ensures a good anchoring of the thermo sensitive layer to the high bright surface of the uncoated, high smoothness paper, forcing the paper through a super calendar in such a way that the smooth surface passes over steel rollers, which entirely close the surface, helping to obtain a highly smooth surface to receive the thermo sensitive layer. Moreover, in this way the thermo sensitive layer is not detached from the base paper during the application of said thermo sensitive layer, during its use in the printing equipment, or afterwards in the handling of the print, retaining the quality of developed images and avoiding soiling the printing equipment.

In an embodiment according to the present disclosure, the color formation is based on an oxidation reaction that the color former undergoes as a result of applying an external heat source to one or more acid substances. In this reaction the molecular ring of the color former is unfolded and opens, forming a complex with the acid which is the color developer through a hydrogen bridge.

Within the reaction the effect of the sensitizers is important, since they work as promoting agents and form a eutectic composite controlling the melting point of the color formers and their developers. It also contributes to obtaining a denser image.

According to the present embodiment, a diamino fluoran compound was selected as black color former, with the following chemical description: 6'-dibutylamino-3'-methyl-2'-(phenilamine)-spiro (isobenzofuran-1(3H), 9-(9H)-xanthen)-3-one (CAS No. 89331-94-2). The concentration of the color former in the thermo sensitive layer was adjusted to provide the desired characteristics. The concentration of the color developer was determined in the same way.

The color developers giving better results include, among others, phenolic compounds such as Bisphenol A, p-hydroxybenzylphenol, also available as bis-(3 allyl-4-hydroxyphenyl)sulfone, benzyl paraben, butyl paraben, benzil-4-hydroxybenzoate, 3,3-dimethyl-4-4 thiobiphenol. For the present embodiment a non-phenolic developer such as a benzenesulfonamide derivative was chosen.

The most common sensitizers include dibenzil terephthalate, dimethyl terephthalate and diarylether compounds. For the present development a diarylether was chosen.

The pigments and white loads used in this embodiment include precipitated calcium carbonate, silica, titanium dioxide, and calcined kaolin with a particle size of 1.5 microns or less. White loads may be selected by their surface area and particle shape. The calcium carbonates, calcined kaolin and silica are, among others, those providing combination possibilities. In order to increase the opacity of the recoated paper a mixture of titanium dioxide and synthetic pigments may be used, although it is the property of absorption which determines a suitable combination of pigments. These pigments also help, among other things, to prevent a migration of the thermo sensitive layer to the thermal element.

The dispersals for fixing on the surface of the paper call for binder, such as polyvinyl alcohol.

This embodiment utilizes low viscosity partially hydrolyzed polyvinyl alcohols such as Elvanol 51-05 or kuraray 205 with viscosities from about 5 to about 8 centipoises (cps) and a percentage of hydrolysis ranging from about 87 to about 89%. The present embodiment may also incorporate specific starches as special binders for coating such as low viscosity hydroxyethyl and/or ethylates in the 100 to 300 cps range and terpolymer emulsions as binders, such as vinylacetate, versatic acid vinylester (Veova™) and acrylic ester, for promoting an excellent moist or dry resistance.

Other necessary additives may include surfactants, dispersants and defoamants in order to control the foam and for a suitable rheology in the formulations. This embodiment further may add a beneficial mixture of surfactant liquid/air and defoamants to the formula. This addition may have the double effect of first softening the difference between peaks and valleys typical of the coatings calibrated with the coating rod and may further contribute to the adhesive in anchoring the thermo sensitive layer to the fiber of the high smoothness paper. In one embodiment according to the present disclosure, different kinds of surfactants and defoamants were evaluated, and non-ionic types such as Surfynol 104, which develops multifunctional properties, and defoamants made from mineral oils and silica derivates, such as Drewplus 131, were selected. With Surfynol 104, on increasing molecular weight through a reaction which augments the number of ethylene oxide moles, a more hydrophilic surfactant is produced which moistens the substrate (high smoothness paper) under more dynamic conditions. The defoamants are added in strictly controlled proportions at a ratio of 1 to 1 and 1% with respect to the sensitizer, color former, and color developer.

According to the present disclosure, the use of waxes or lubricant agents is considered as well as zinc stearate, in order to avoid the emission of dust or fines to the heat source.

In relation to other methods, such as those as described in international patent application publication WO 2005/084958, published Sep. 9, 2005, application of the thermo sensitive layer is normally done with high precision and rain control equipment, which implies utilizing equipment with a high investment cost. When the coating rod has been used to calibrate the freshly-applied thickness of the thermo sensitive layer, it drags the fresh emulsion and leaves a grooved surface which degrades the quality of the image to be generated by the thermal print. For example, this technique is mentioned in U.S. Pat. No. 6,613,716 issued Sep. 2, 2003. The formula disclosed in this patent possesses rheological and surface tension characteristics which allow an optimum terse and smooth surface to be obtained from the thermo sensitive coating, not presenting the roughness (in the form of grooves) which is typical or characteristic of coatings whose freshly-applied thickness is calibrated by the use of coating rods. Additionally, the tenacity of the fresh emulsion and its adherence to the substrate (high smoothness paper) avoid contact with the coating rod carrying the fresh emulsion. This way, the double effect is achieved of the coating having a highly smooth surface, which contributes to the obtaining of highly defined images, and simultaneously providing a complete coverage (i.e., avoiding the presence of non-sensitized areas).

In certain embodiments, papers with a smooth face, as prepared according to the present disclosure, may have an evenness value of 80 $cm^3$/min measured on the Bendsten scale. These smooth values as compared with those presented by pre-coated paper are described in the following table:

TABLE NO. 1

| Paper Description | Base Weight $G/M^2$ | Bendsten Smoothness $cm^3$/min. |
|---|---|---|
| Uncoated High Smoothness Paper | 65 | 80 |
| Pre-coated Paper | 67 | 76 |

Table 1 shows the smoothness values for the papers used as a base for the thermal papers. The smoothness quality of an uncoated high smoothness paper may be virtually the same as with paper with pre-coating.

Opacity, which is another characteristic traditionally associated with pre-coated papers, may be achieved in papers according to the present disclosure by the introduction of a pigment which provides opacity to the thermo sensitive layer formula. According to one embodiment, this may be obtained with a mixture of 50 pts calcined kaolin, 44 pts calcium carbonate, 5 pts titanium dioxide, and 1 part silicon dioxide.

Preparation of the thermo sensitive layer may require individual preparation of the following reagents:

1. Reagent incorporating the color former: This is the color former plus part of the sensitizer, and a proportional part of the adhesive. Dispersal aids, defoamant agents and surfactant additives to regulate viscosity also may be present.
2. The acid reagent carrying the color developer comprising the sensitizer complement and the necessary adhesive to fix the formula. Dispersal aids, defoamant agents, dispersal agents, and surfactant additives to regulate the viscosity also may be present.
3. Properly dispersed white loads Reagent preparation requires a milling process. The size of the particle should be close to 2 to 2.5 microns. It may be preferable that the mills used for this operation have a cooling jacket to prevent a rise in temperature during the process, which may result in a premature reaction.

A polyvinyl alcohol solution may be prepared separately and combined with the components to be described later among the examples mentioned. Mixing may begin in a moderate speed mixer, and the percentage of solids may be controlled in accordance with the formula.

Following are 6 exemplary composition and preparation processes of a thermo sensitive layer according to the present embodiment suitable for high smoothness papers, as well as the results of each one following application over high smoothness paper.

Example No. 1

The reagent containing the color former (diamino fluoran compound) may be prepared as follows:

A 20% polyvinyl alcohol solution may be prepared in a recipient which can be either Elvanol or kuraray with a viscosity between about 5 cps to about 6 cps and with a percent hydrolysis of 87 to 89%. At the same time, in an 1,750 RPM Cowles mixer, 3 parts of the color former compound diamino fluoran may be added to 3.5 parts of diarylether together with the previously-prepared polyvinyl alcohol representing 5 parts of the dry base, with Drewplus 1-131 defoamant (mineral oils and silica derivatives) in a percentage of 0.05% as compared with the color former used, also incorporating a mixture of surfactants such as Surfynol 420 and Surfynol 104 representing 0.05% of the total.

The dispersal mixture may be introduced into a mill with a water-cooled grinding chamber, until a particle size of 2.0 to 2.5 micron is obtained.

The complementary reagent containing the color developer (a non-phenolic derivative of benzene sulfonamide) may be prepared as follows:

A solution of 20% Elvanol 51-05 of from 5 to 6 cps and 87-89% hydrolysis may be prepared in a recipient. The color developer may be prepared in the same way as the reagent containing the color former. To this end, 8.5 parts of developer may be mixed with 1.5 parts sensitizer and milling may be controlled to a particle size of from 2.0 to 2.5 microns.

Once the dispersals of both reagents have been completed, they may be mixed inside a Cowles type mixer and the polyvinyl alcohol 5 pts dry base solution may be incorporated in addition to a dispersal of Zink Stearate 35%, 15 parts (dry base) and a 50% paste of 25 parts calcined kaolin (dry base).

The paste prepared in this way may be adjusted at a viscosity of 15 seconds in Ford cup No. 6. In this phase a combination of dispersal agents and defoamants may need to be added in order to control the fluidity of the thermo sensitive layer.

Below is a table showing the composition of the mixture used in this first example:

| Description | Dry base amount |
|---|---|
| Diamino fluoran compound | 3.0 |
| Non-phenolic benzene sulfonamide derivative developer | 8.5 |
| Diarylether sensitizer compound | 5.0 |
| Elvanol 51-05 5 to 6 cps 89-89%, 20% hydrolysis in solution | 10.0 |
| Zinc Stearate at 30% | 15 |
| Calcined kaolin paste at 50% | 25 |
| Drewplus L191 defoamant | 0.15 |
| Surfactant Surfynol104 and 420 (2,4,7,9 Tetra methyl-5 decine-4,7 diol) | 0.15 |

Example No. 2

Following the same form of preparation for both reagents as in EXAMPLE No. 1, the following mixture was prepared:

| Description | Dry Base amount |
|---|---|
| Diamino flouran compound | 3.5 |
| A non-phenolic developer derived from benzene sulfonamide | 8.5 |
| Diarylether compound Sensitizer | 5.0 |
| 46-66 WF hydroxyethyl starch at 20% | 2.5 |
| Elvanol 51-05 5 to 6 cps 87-89% hydrolysis at 20% in solution | 2.5 |
| aqueous emulsion terpolymer of vinyl acetate terpolymer, Veova ™, and acryl ester | 5.0 |
| Zinc stearate at 30% | 15 |
| Calcium Carbonate paste at 30% | 25 |
| Drewplus L191 Defoamant | 0.1 |
| Surfactant Surfynol 104 and 420 (2,4,7,9 Tetra methyl .- 5 decine-4, 7 diol) | 0.1 |

A proportion of chemically modified starch of the kind widely used as co-binders in water-based coatings was introduced in this example. This may improve the adhesive power and the starch may be plasticized in order to form a more flexible film with materials such as polyvinyl alcohol, as well as taking advantage of the property of the starch as a flow regulator. An aqueous emulsion of terpolymer dispersal based on vinyl acetate, Veova™ (versatic acid vinyl ester), and acrylester also may be introduced in order to balance coating characteristics, comprising a combination of three monomer units, which may increase the bonding adhesive between paper fibers and the thermo sensitive color layer, without altering its image-reproducing properties.

Example No. 3

The same method of preparation is followed in this example as in the two previous cases:

| Description | Dry Base amount |
|---|---|
| Diamino fluoran compound | 3.5 |
| A non-phenolic developer derived from benzene sulfonamide | 8.5 |
| Diarylether compound sensitizer | 5.0 |
| 20% 46-66 WF hydroxyethyl starch | 2.5 |
| Elvanol 51-05 5 to 6 cps 87-89% hydrolysis at 20% | 2.5 |
| Vinyl acetate terpolymer, Veova, and | 5.0 |
| Aqueous emulsion terpolymer of vinyl acetate terpolymer, Veova ™, and acryl ester | 5.0 |
| Pigment mixture at 50% | 25 |
| Zinc stearate at 30% | 15 |
| Drewplus L191 defoamant | 0.1 |
| Surfactant Surfynol 104 and 420 (2,4,7,9 Tetra methyl-5 decine-4, 7 diol). | 0.1 |

In this formula the reactors, color former and color developer may be prepared as described in example no. 1, and a pigment mixture may be prepared independently to provide greater covering power, even though the weight of the thermo sensitive layer is less. This mixture consists of 50 pts calcined kaolin, 44 pts calcium carbonate, 5 pts Titanium Dioxide (Rutile grade), and 1 part Silicon dioxide, and may be prepared by moisturizing components in diethyl glycol and Astropol 30 and subsequently passed through a roller mill.

Once the preparation has been completed, it may be applied over different papers, e.g., a high smoothness paper of 65 g/m$^2$ and a pre-coated paper of 67 g/m$^2$, as shown in Results table II. The coating rods system and rod no. 6 may be used to apply the thermo sensitive layer in order to deposit a layer with a weight of 4 to 6 g/m$^2$.

Example No. 4

The following formula was used in this example:

| Description | Dry Base amount |
|---|---|
| Diamino fluoran compound | 3.5 |
| A non-phenolic developer derived from benzene sulfonamide | 8.5 |
| Diarylether compound sensitizer | 5.0 |
| Ethyl starch at 20% | 4.0 |
| Elvanol 51-05 5 to 6 cps 87-89% hydrolysis at 20% | 6.0 |
| Calcium Carbonate paste at 50% | 25 |
| Zinc stearate at 30% | 10 |
| Drewplus L191 defoamant | 0.1 |
| Mixim Antioxidant ao-30 | 0.1 |
| Surfactant Surfynol 104 and 420 (2,4,7,9 Tetra methyl-5 decine-4, 7 diol) | 0.1 |

The color former and color Developer reagents may be prepared as described in example no. 1, where the pigment paste may be based on calcium carbonate prepared by moisturizing as described in example 3. The resulting paste may be finished at 50% solids. In this example the purpose is to make the aging-resistant paper achieve a lasting image, which may be developed through antioxidant papers which avoid yellowing and a loss of image. The final mixture comprising the thermo sensitive layer may be deposited through the coating rod mechanism.

Example No. 5

The following formula was used in this example:

| Description | Dry Base Amount |
|---|---|
| Diamino fluoran compound | 3.5 |
| A non-phenolic developer derived from benzene sulfonamide | 8.5 |
| Diarylether composed Sensitizer | 5.0 |
| Hydroxyethyl starch of 20% | 4.0 |
| Elvanol 51-05 5 to 6 cps 87-89% hydrolysis at 20% in solution | 6.0 |
| Calcined kaolin paste at 50 | 25 |
| Zinc stearate at 30% | 15 |
| Drewplus L131 defoamant | 0.1 |
| Surfactant Surfynol 104 and 420 (2,4,7,9 Tetra methyl-5 decine-4, 7 diol) | 0.1 |

The preparation of the reagents color former and color developer may be prepared as described in example no. 1. In this example the pigment paste may be based on calcined kaolin, prepared by moisturizing as described in example 3.

This example shows the difference between papers presenting a resistance to aging as in the thermo sensitive layer of example 4.

Example No. 6

The following formula was used in this example:

| Description | Dry Base Amount |
|---|---|
| Diamino fluoran compound | 3.5 |
| A non-phenolic developer derived from benzene sulfonamide | 8.5 |
| Diarylether composed Sensitizer | 4.0 |
| Elvanol 51-05 5 to 6 cps 87-89% hydrolysis at 20% | 6.0 |
| Mixim antioxidant Ao-30 | 0.1 |
| Pigment mix at 50% | 25 |
| Zinc stearate at 30% | 10 |
| Drewplus L191 defoamant | 0.1 |
| Surfactant Surfynol 104 and 420 Tetra methyl-5(2,4,7,9 decine-4, 7 diol) | 0.1 |

Each one of these examples was prepared according to example no. 1 utilizing the equipment described. The size of the particle may be between 2.0 and 2.5 microns. Thermal color preparations developed in this way were applied on two types of paper using rod no. 6 to deposit an average of 4 to 6 g/m2. The viscosity was adjusted in all cases to give 15 seconds in the copa Ford No. 4. The results of Examples 1 to 6 are shown in Table II.

Results of these examples appear in the following table TABLE No. II

| | High Smoothness Paper 65 g/m$^2$ IMAGE INTENSITY | Pre-coated paper 67 g/m$^2$ IMAGE INTENSITY |
|---|---|---|
| Example 1 | Better image definition | Defined image |
| Example 2 | Better image definition | Defined image |
| Example 3 | Better image definition | Defined image |
| Example 4 | Better image definition | Defined image |
| Example 5 | Better image definition | Defined image |
| Example 6 | Better image definition | Defined image |

A Zebra Atlantek thermal printer and a 1200 Macbeth Densitometer were used to evaluate the image intensity of each exemplary paper prepared according to various embodiments according to the present disclosure. Examples 1 to 6 were covered over two different types of paper, one pre-coated with a kaolin coat and natural and synthetic adhesives such as starch and styrene butadiene latex, and an uncoated paper but presenting high smoothness on one of the faces which, as mentioned elsewhere, occurs mainly because during the manufacturing process and while moist, it is placed in contact with a high bright metal surface and the composition of the pulp favors this high bright effect. One can appreciate the smoothness obtained from the results shown in Table I.

Text images were generated; logos with dark areas and bar codes were copied. Texts were put through a scanner and successfully processed in optical character recognition software. The solid color areas of the logo figures were satisfactory as regards density.

The best results were obtained when either hydroxyethylated or ethylated starch and an aqueous emulsion terpolymer of vinyl acetate, Veova™ and acryl ester were added to the binder as described in examples 3, 5 and 6. In these examples, the presence of a combination of white pigments or loads also influences an improvement in the print. From these examples, the paper with the most adhesiveness between the thermo sensitive layer and the base was example 3, which may be due to the presence of a terpolymer in the formula as binder.

The coating rod mechanism may be used to apply the thermo sensitive layer utilizing rod no. 6, thus achieving a uniform distribution of the thermo sensitive layer weight of from 4 to 6 g/m$^2$ is obtained over the entire width of the paper tape, without the need for a system as complex as that used by the grooving system.

In comparing the intensity of images obtained using the foregoing process with others obtained employing sensitive papers utilized by other processes, it can be seen that those obtained from the present process are in some cases better, or at least the same.

The inventions disclosed herein may provide a thermo-sensitive paper having a quality comparable to, if not better than, products currently existing in the art, while lowering the raw material and processing costs of preparing such papers.

From this selective investigation it was found that the base paper which provided the smoothness and absorption properties required is a paper manufactured and dried over a dryer with a chromed surface allowing the paper surface to possess the smoothness required to receive coatings without surface problems. This type of paper is known as machine glossed.

To improve the machine glossed paper surface even more and decrease absorption, it had to be placed on a calender via iron rods and cotton, thus obtaining a paper able to receive the thermo sensitive layer and retaining a surface with the required smoothness and absorption.

Once the paper serving as a base for the heat-sensitive material layer was obtained, the formula or formulas of this were developed for surface application in order to complete the product.

In developing composition of the thermo sensitive layer for application on the surface of the machine glossed paper to be used as a base, another specific condition required to utilize suitable coating equipment was found, this being utilization of the coating rod system as the sole economic solution. The sensitive layer would therefore have to be adjusted for suitable placement with this equipment only uses as being the only economic one, the composition of the sensitive layer would need to be adjusted in order to be suitably placed with this equipment, requiring specific formulas to provide the fluidity and mobility for use of the available equipment.

The invention claimed is:

1. A thermal paper for the printing of images and texts in thermal printers, comprising:

1. a substrate of a high smoothness paper not previously covered, and
2. an applied emulsion layer which forms a thermo sensitive layer; the thermo sensitive layer comprising
   a. at least one color former component;
   b. at least one color developer;
   c. at least one sensitizer;
   d. at least one additive comprising at least one surfactant, at least one defoamant, or a combination thereof,
   e. at least one adhesive comprising a partially hydrolyzed low molecular weight polyvinyl alcohol having a controlled viscosity of 5 to 8 cps, a modified starch selected from an ethyl hydroxyethyl low viscosity starch having a viscosity between 100 and 300 cps, or a combination thereof; and
   f. a binder comprising an aqueous emulsion terpolymer of vinyl acetate, vinyl ester of versatic acid, and acryl ester.

2. A thermal paper according to claim 1 wherein said thermo sensitive layer is applied to the base paper by a coating rod system.

3. A thermal paper according to claim 1, wherein said additive includes ethoxylated 2,4,7,9-tetramethyl 5 decyn-4, 7-diol.

4. A thermal paper according to claim 1, wherein said surfactant is 2,4,7,9-tetramethyl-5-alkyne-4-7-diol.

5. A thermal paper according to claim 1, wherein said additive is selected from the group consisting of a mineral oil, a silica derivative, and a combination thereof.

6. The thermal paper according to claim 1 wherein said modified low viscosity starch has a viscosity of between 100 and 200 cps, and partially hydrolyzed low molecular weight polyvinyl alcohol has a viscosity of 6 to 7 cps, with a hydrolysis percentage of 88%.

7. The thermal paper according to claim 1 wherein said partially hydrolyzed polyvinyl alcohol has a viscosity of 6 to 7 cps, and has a degree of hydrolysis from 86 to 89%.

8. A process for manufacturing thermal paper, comprising the application of an aqueous emulsion to an uncoated high smoothness base paper, the emulsion comprising a. at least one color former,
b. at least one color developer;
c. at least one sensitizer;
d. an additive comprising at least one surfactant, at least one defoamant, or a combination thereof;
e. an adhesive having a low molecular weight partially hydrolyzed polyvinyl alcohol with a viscosity of 5 to 8 cps, a modified starch selected from low viscosity ethylated and hydroxyethylated starches of between 100 to 300 cps, or a combination thereof; and
f. a binder comprising an aqueous emulsion terpolymer of vinyl acetate, vinyl ester of versatic acid, and acrylester.

9. The process according to claim 8, wherein said emulsion is applied by use of a calibrated coating rod system.

* * * * *